US010310429B2

(12) United States Patent
Tanabe

(10) Patent No.: US 10,310,429 B2
(45) Date of Patent: Jun. 4, 2019

(54) IMAGE FORMING APPARATUS

(71) Applicant: CANON KABUSHIKI KAISHA, Tokyo (JP)

(72) Inventor: Yuichi Tanabe, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/846,459

(22) Filed: Dec. 19, 2017

(65) Prior Publication Data

US 2018/0173143 A1 Jun. 21, 2018

(30) Foreign Application Priority Data

Dec. 19, 2016 (JP) ..... 2016-245735

(51) Int. Cl.
*G03G 15/00* (2006.01)
*G03G 15/01* (2006.01)

(52) U.S. Cl.
CPC ..... *G03G 15/5054* (2013.01); *G03G 15/0131* (2013.01); *G03G 2215/00059* (2013.01)

(58) Field of Classification Search
CPC ..... G03G 15/5058; G03G 15/0131; G03G 15/5054; G03G 2215/00059; G03G 2215/00042
See application file for complete search history.

(56) References Cited

U.S. PATENT DOCUMENTS

| | | | | |
|---|---|---|---|---|
| 9,383,700 | B2 | 7/2016 | Tani et al. | |
| 2012/0237233 | A1* | 9/2012 | Kato | G03G 15/0131 399/49 |
| 2013/0004189 | A1* | 1/2013 | Hashiguchi | G03G 15/5058 399/49 |
| 2015/0277320 | A1* | 10/2015 | Tani | G03G 15/5033 399/74 |

FOREIGN PATENT DOCUMENTS

| | | | |
|---|---|---|---|
| JP | 2002-131997 | A | 5/2002 |
| JP | 2011-059369 | A | 3/2011 |
| JP | 2015-197558 | A | 11/2015 |

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus includes a sensor and a shutter to cover a window for the sensor. The shutter includes a detection hole to uncover the window and a cover portion to cover it. In an opening position of the shutter, the window and the hole are opposed to each other, and in a closing position of the shutter, the window and the cover portion are opposed to each other. A holder for the sensor includes a side wall opposed to a side of the sensor remote from a sheet feeding path and extended in a widthwise direction. As viewed in a horizontal direction perpendicular to the belt, the side wall is provided with a first area overlapping the hole in the closing position and a second area overlapping the window in the closing position. The first area is below the shutter and lower than the second area.

15 Claims, 8 Drawing Sheets

IMAGE FORMING APPARATUS

FIELD OF THE INVENTION AND RELATED ART

The present invention relates to an image forming apparatus such as a copy machine, a printing machine, a facsimile machine, a multifunction machine capable of functioning as two or more of the preceding machines, etc., which employs an electrophotographic method or an electrostatic recording method.

There have been known such image forming apparatuses structured so that a toner image is transferred (primary transfer) from its photosensitive drum onto its intermediary transfer belt, and then, the toner image is transferred (secondary transfer) from the intermediary transfer belt onto a sheet of recording medium. There have also been known such image forming apparatuses structured so that a control toner image is formed on its intermediary transfer belt, and various control processes are carried out based on the results of the detection of the control toner image by sensors.

In the case of an image forming apparatus structured as described above, it is possible that as foreign particles such as toner particles and paper dust particles adhere to the detection surface of the sensor, the sensor will reduce in detection accuracy. Thus, it has been proposed an image forming apparatuses structured so that the detection surface of its sensor is covered with a protective member having detection holes (Japanese Laid-open Patent Application No. 2002-131997). The image forming apparatus disclosed in Japanese Laid-open Patent Application No. 2002-131997 is provided with a protective member, and is structured so that as the main door with which the main assembly of the apparatus is closed, the protective member is moved to a preset position in which it exposes the detection surface of the sensor through its detection holes, whereas as the door is opened, the protective member is moved to a preset position in which it keeps the detection surface covered.

The sensor which detects the toner image formed on the intermediary transfer belt is disposed between the primary transferring portion in which the toner image is transferred from the photosensitive drum onto the intermediary transfer belt, and the secondary transferring portion in which the toner image is transferred from the intermediary transfer belt onto a sheet of recording medium. The sensor is likely to be disposed near the secondary transferring portion, and also, in the adjacencies of the recording medium conveyance passage through which the sheet is conveyed to the secondary transferring portion. Thus, foreign particles such as toner particles and paper duct particles are likely to accumulate on the area which is below the detection hole of the protective member. More specifically, in a case where the detection surface remains covered with the protective member, foreign substances (contaminants) accumulates on the area below the detection hole, which in this case is offset from the detection surface of the sensor. Further, if the protective member is moved to the position in which its keeps the detection surface exposed through its detection hole while the foreign substances (contaminants) having accumulated on the aforementioned area is still on the area, it is likely that the foreign substances (contaminants) are carried by the protective member, and adhere to the detection surface of the sensor.

SUMMARY OF THE INVENTION

Thus, the primary object of the present invention is to provide a structural design for an image forming apparatus, which makes it unlikely for foreign substance (contaminants) to adhere to the detection surface of a toner image sensor of the apparatus.

According to an aspect of the present invention, there is provided an image forming apparatus comprising an image bearing member; a rotatable intermediary transfer member configured to receive a toner image from said image bearing member at a primary transfer portion opposing said image bearing member; a secondary transfer member constituting a secondary transfer portion configured to contact said intermediary transfer member to transfer the toner image from said intermediary transfer member onto the recording material; a feeding path configured to feed the recording material to said secondary transfer portion; a sensor provided opposed to said intermediary transfer member below said intermediary transfer member at a position downstream of said primary transfer portion and upstream of said secondary transfer portion and configured to detect the toner image on said intermediary transfer member; a shutter movably provided between said sensor and said intermediary transfer member and configured to cover at least a part of a window for detection by said sensor, wherein said shutter includes a detection hole configured to uncover said window to permit detection of the toner image on said intermediary transfer member and a cover portion configured to cover said window, and wherein when said shutter is in an opening position, said window and said detection hole are opposed to each other, and when said shutter is in a closing position, said window and said cover portion are opposed to each other; and a holding member configured to hold said sensor, said holding member including a side wall opposed to a side of said sensor remote from said feeding path and extended in a widthwise direction perpendicular to a rotational moving direction of said intermediary transfer member, wherein as viewed in a horizontal direction perpendicular to widthwise direction of said intermediary transfer member, said side wall is provided with a first area overlapping with said detection hole in a vertical direction when said shutter is in the closing position and a second area overlapping with said window in the vertical direction when said shutter is in the closing position, and wherein the first area is below a lower surface of said shutter and is lower than the second area.

Further features of the present invention will become apparent from the following description of exemplary embodiments with reference to the attached drawings.

Figure 2:
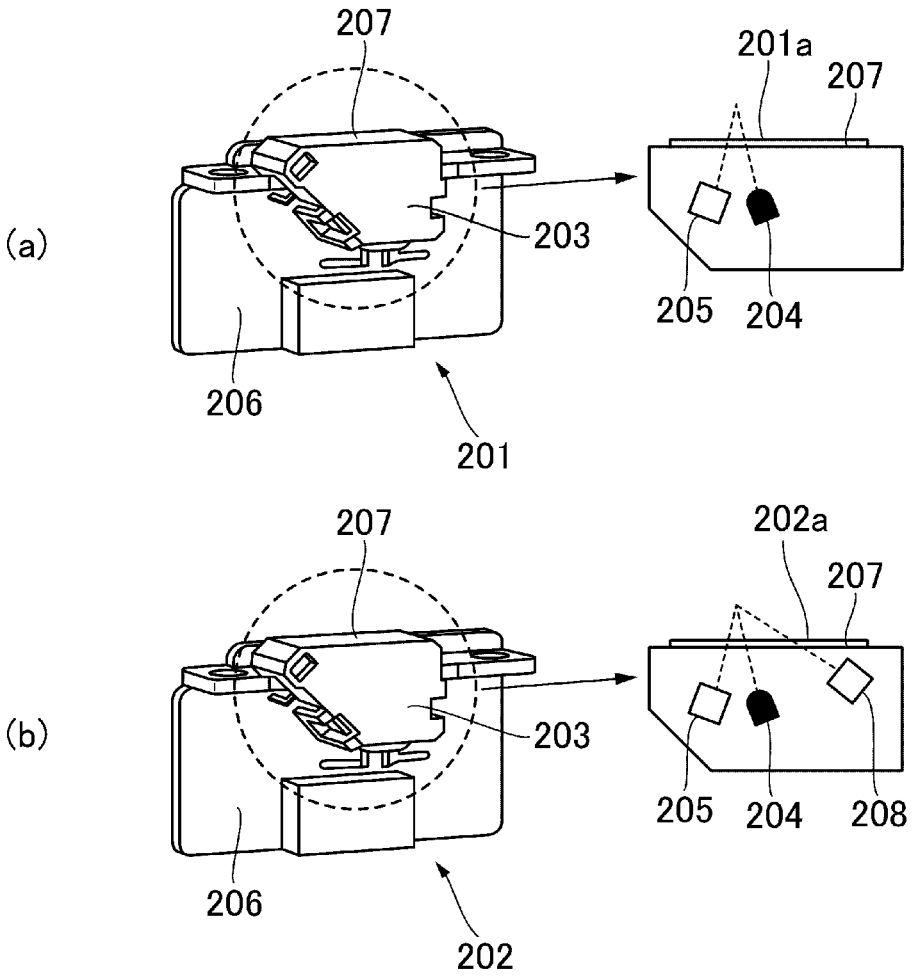

Part (a) of FIG. 2 is a combination of a perspective view of the first sensor of the sensor unit of the apparatus and a schematic side view of the first sensor, and part (b) of FIG. 2 is a combination of a perspective view of the first sensor of the sensor unit of the apparatus and a schematic side view of the first sensor.

Figure 3:
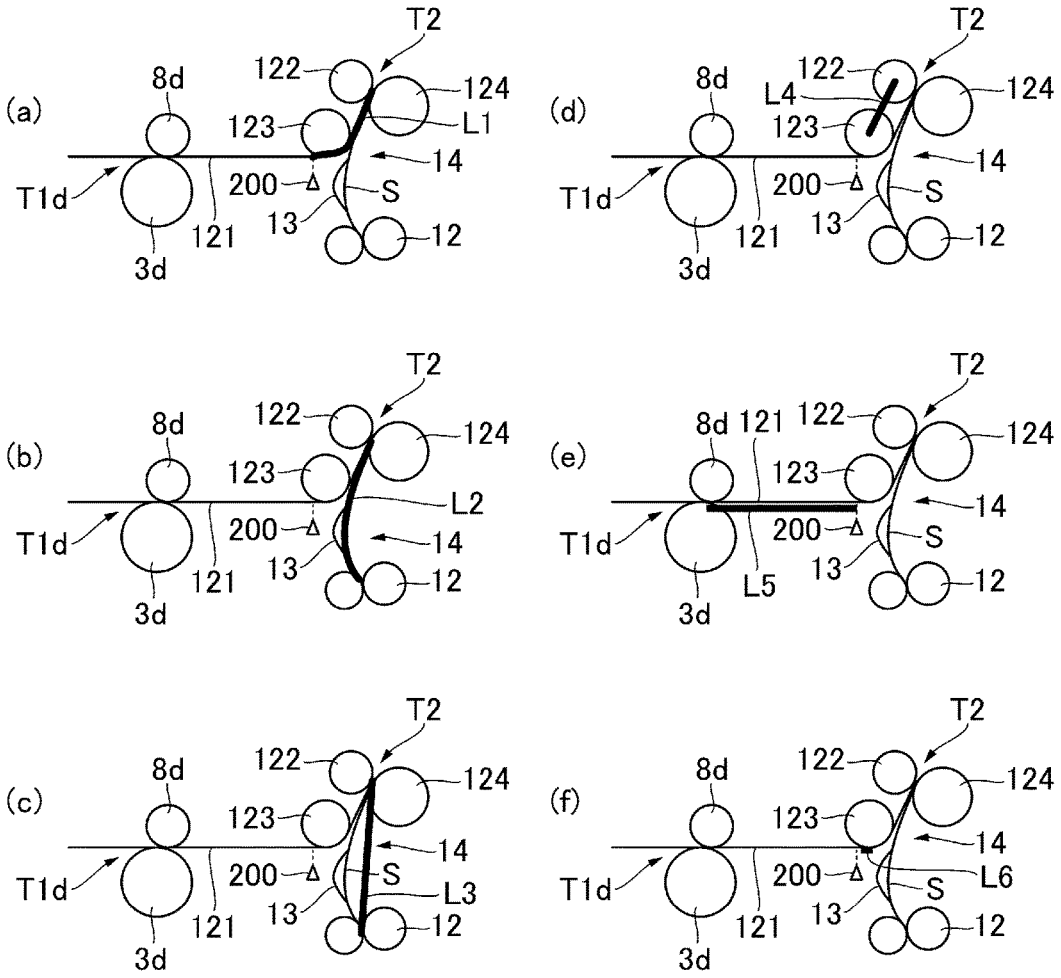

Parts (a), (b), (c), (d), (e) and (f) of FIG. 3 are schematic drawings of the secondary transferring portion and its adjacencies, which show the distances between the second transferring portion and sensor, distance (length of portion of sheet of recording medium) between the secondary transferring portion and a pair of registration rollers, distance between the secondary transferring portion and the pair of registration rollers, distance between the secondary transfer portion inside roller and a secondary transferring portion front roller, distance between the primary transferring portion and sensor, and distance between the secondary transferring portion front roller and sensor, respectively.

Figure 4:
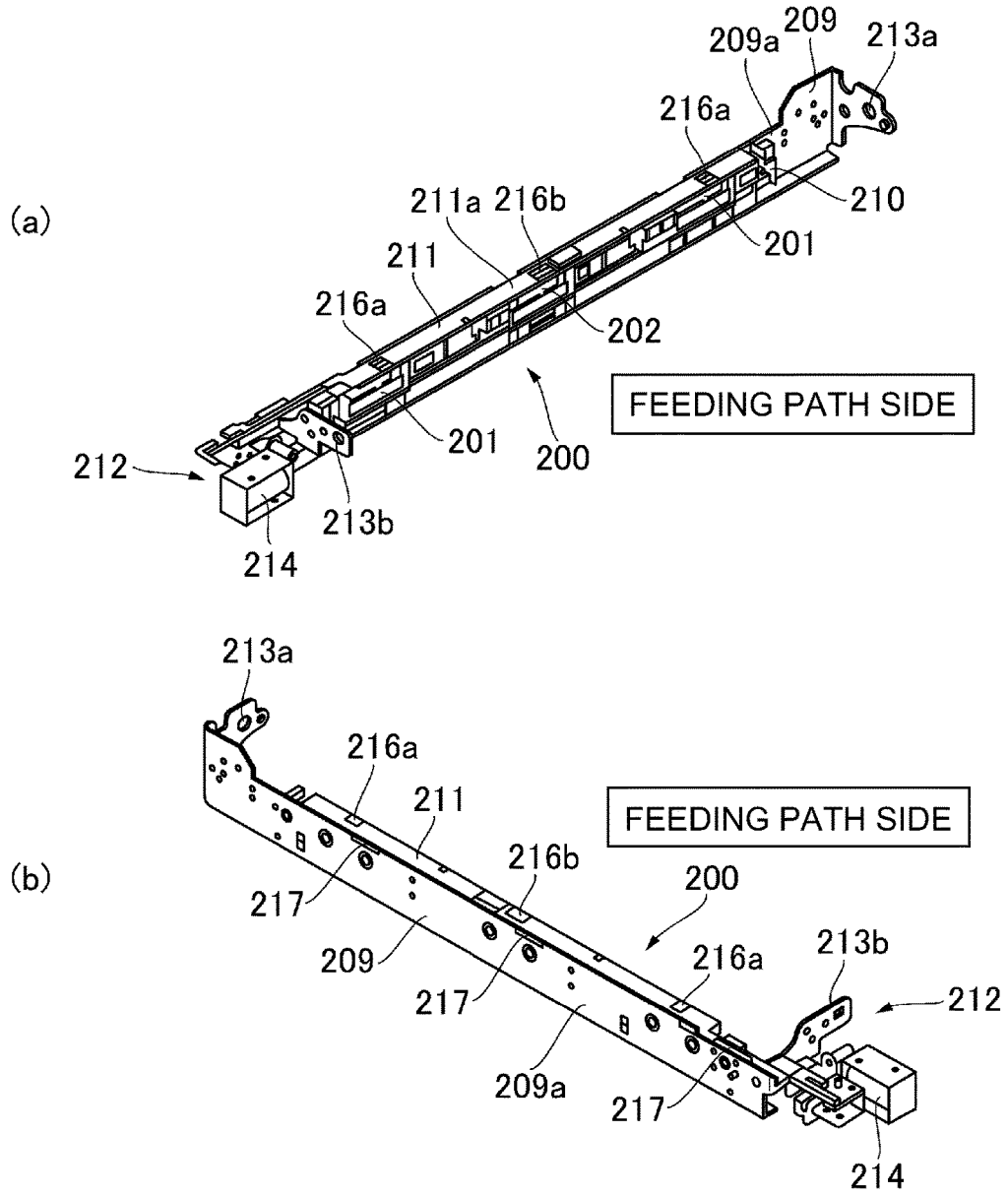

Part (a) of FIG. 4 is a perspective view of the sensor unit as seen from the recording medium conveyance passage side, and part (b) of FIG. 4 is a perspective of the sensor unit as seen from the opposite side of the recording medium conveyance passage from the sensor unit.

Figure 5:
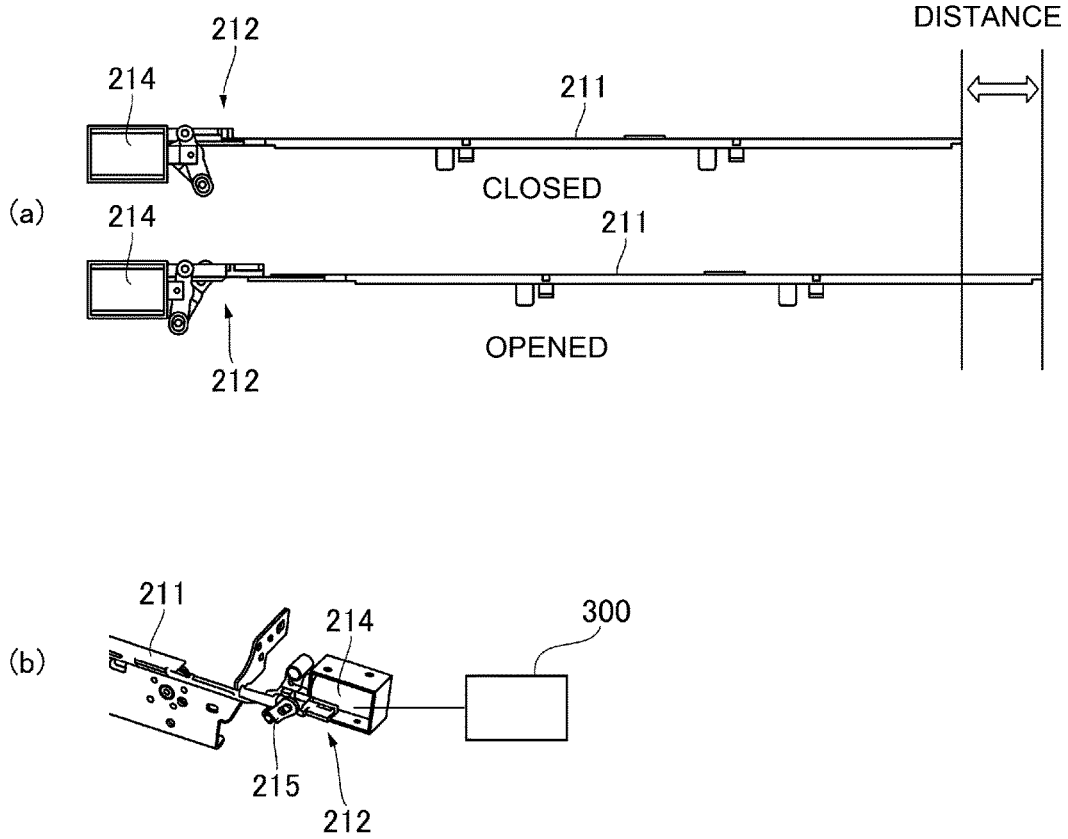

Part (a) of FIG. 5 is a schematic side view of two combinations of a solenoid 214, a shutter moving mechanism 212, and a protective shutter 211 when the shutter is remaining closed, and is open, respectively, and is for showing the distance the protective shutter 211 is moved, and part (b) of FIG. 5 is a perspective view of the shutter moving mechanism and its adjacencies.

Figure 6:
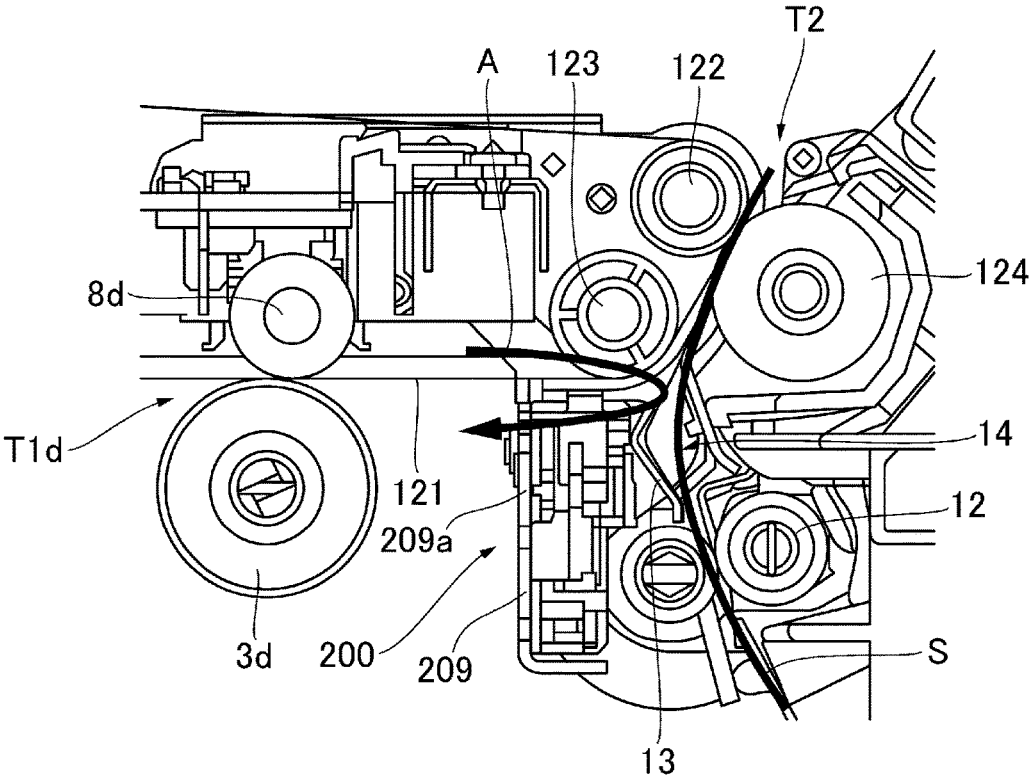

FIG. 6 is a schematic side view of the sensor unit, and its adjacencies, in the image forming apparatus in the preferred embodiment; it shows the general structure of the sensor unit of the image forming apparatus, and its adjacencies.

Figure 7:
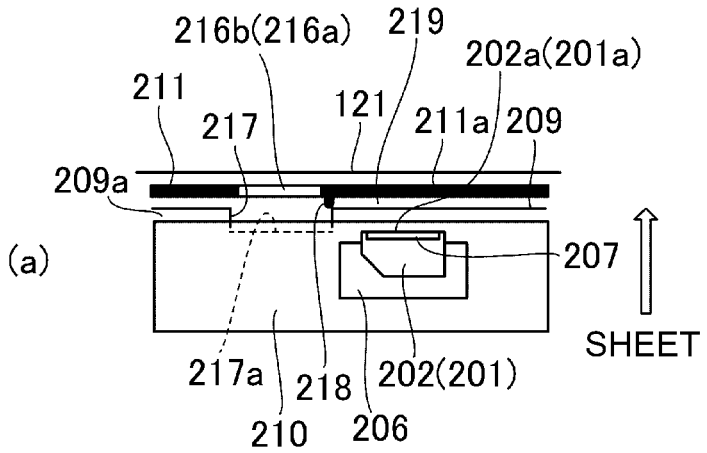
Figure 7:
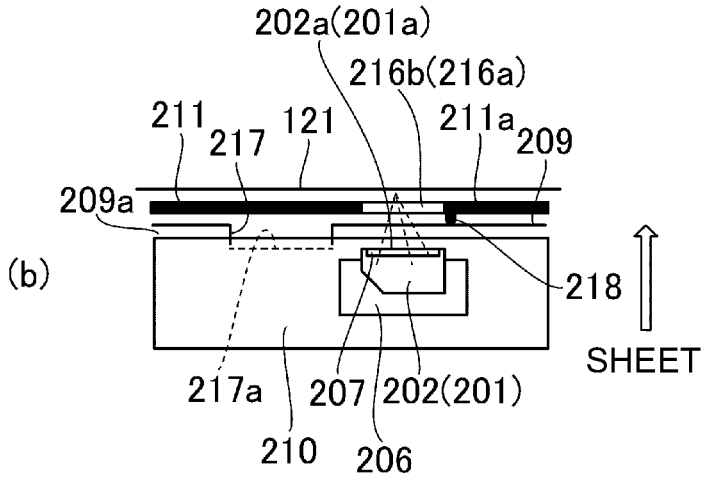

Parts (a) and (b) of FIG. 7 are schematic side views of the sensor unit when the protective shutter is remaining closed, and open, respectively; they show the positional relationship between the sensor and protective shutter.

Figure 8:
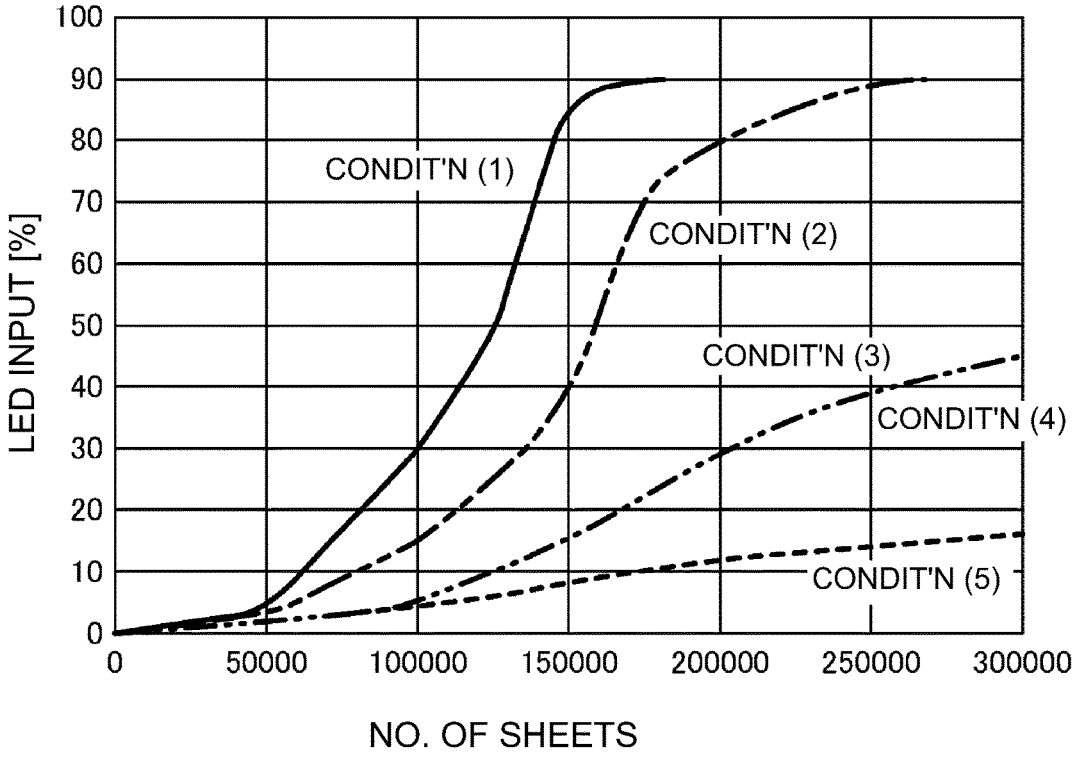

FIG. 8 is a graph which shows the relationship between the cumulative number by which sheets of recording medium were conveyed through the image forming apparatus, and the amount (%) by which electric power is inputted into the LED of the sensor unit.

Figure 9:
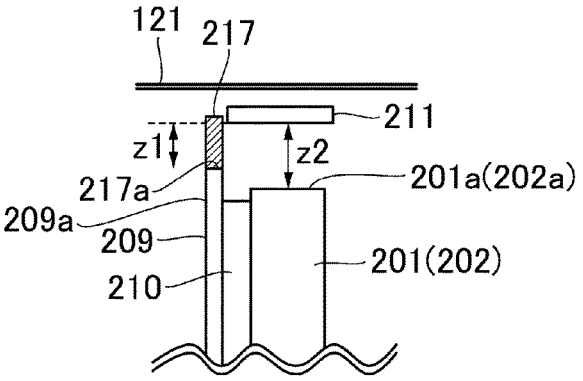

FIG. 9 is a schematic drawing for showing the positional relationship between the bottom surface of one of the slots of one of the side walls of the frame of the sensor unit, and the detection surface of the sensor.

DESCRIPTION OF THE EMBODIMENTS

Hereinafter, referring to FIGS. 1-9, one of the preferred embodiments of the present invention is described. First, referring to FIG. 1, the image forming apparatus in this embodiment is described about its general structure.

[Image Forming Apparatus]

The image forming apparatus 100 in this embodiment is a full-color image forming apparatus which uses an electrophotographic image forming method. It is of the so-called tandem type.

The image forming apparatus 100 is an electrophotographic full-color printer of the tandem type. It has four image forming portions 2*a*, 2*b*, 2*c* and 2*d*, which have photosensitive drums 3*a*, 3*b*, 3*c* and 3*d*, as image bearing members, respectively. It forms a toner image on a sheet of recording medium in response to the image formation signals from an original reading apparatus (unshown), which is in connection to the main assembly 100A of the image forming apparatus 100, or a host device such as a personal computer, which is in connection to the main assembly 100A of the image forming apparatus 100 in such a manner that information can be exchanged between the image forming apparatus 100 and host device. As the recording medium, a sheet of ordinary paper, an envelope, a sheet of plastic film, a sheet of cloth, etc., can be listed. The image forming portions 2*a*, 2*b*, 2*c* and 2*d* form yellow, magenta, cyan and black toner images, respectively.

By the way, the four image forming portions 2*a*, 2*b*, 2*c* and 2*d*, with which the image forming apparatus 100 is provided, are practically the same in structure, except that they are different in the color of the developer they use. Thus, the image forming portion 2*a* is described as a portion that represents the four image forming portions; the image forming portions 2*b*, 2*c*, and 2*d* are not described since their descriptions are the same as that of the image forming apparatus 2*a* except for the suffixes b, c and d which indicates their relationship to the color components, one for one, into which the image to be formed is separated.

There is disposed a photosensitive drum 3, which is a cylindrical photosensitive member as an image bearing member, in the image forming portion 2. The photosensitive drum 3*a* is rotationally driven in the direction indicated by an arrow mark in the drawing. There are also disposed a charging apparatus 5*a* (charge roller) as a charging means, a developing apparatus 7*a*, the primary transfer roller 8*a*, and a cleaning apparatus 4*a* as a cleaning means, in the adjacencies of the peripheral surface of the photosensitive drum 3*a*. There is also disposed a laser scanner 6*a* (exposing apparatus) as an exposing means, below the photosensitive drum 3*a* in the drawing.

Further, there is disposed an intermediary transferring apparatus 120 on the top side of the combination of the image forming portions 2*a*, 2*b*, 2*c* and 2*d* in the drawing. The intermediary transferring apparatus 120 has an intermediary transfer belt 121 as an intermediary transferring member, which is a rotationally movable endless belt. The intermediary transfer belt 121 is suspended and tensioned by multiple rollers, and is rotationally driven in the direction indicated by an arrow mark in the drawing. After being formed on the peripheral surface of the photosensitive drum 2*a*, a toner image is transferred (primary transfer) onto the intermediary transfer belt 121 as will be described later. Then, the intermediary transfer belt 121 conveys a toner image by bearing the toner image. The intermediary transferring apparatus 120 is provided with a pair of secondary transfer rollers, more specifically, the secondary transfer inside roller 122 which is disposed on the inward side of the loop which the intermediary transfer belt 121 forms, and the secondary transfer outside roller 124 which is disposed on the outside the belt loop. The two secondary transfer rollers 122 and 124 are disposed so that they sandwich the intermediary transfer belt 121, forming thereby the secondary transferring portion T2 in which the toner image on the intermediary transfer belt 121 is transferred onto a sheet of recoding medium. The secondary transfer outside roller 124 is rotatably supported by its lengthwise end portions, by a pair of bearings, in such a manner that it is kept pressed toward the intermediary transfer belt 121 by the force generated in the direction of the intermediary transfer belt 121 by a pair of elastic members.

In particular, the intermediary transfer belt 121 in this embodiment, is suspended and tensioned in such a manner that the portion of the intermediary transfer belt 121, which faces the photosensitive drums 3*a*-3*d* of the image forming portions 2*a*-2*d*, respectively, is roughly horizontal, and also, that it is suspended and tension by the secondary transfer front roller 123 as the belt supporting-tensioning second roller, on the immediate upstream side of the secondary transferring portion T2. That is, with respect to the direction in which the intermediary transfer belt 121 is rotated, the secondary transfer front roller 123 suspends and keep tensioned the intermediary transfer belt 121 on the downstream side of the primary transferring portion T1, and the upstream side of the secondary transfer inside roller 122. There is disposed a fixing apparatus 15 on the downstream side of the secondary transferring portion T2 with respect to the recording medium conveyance direction.

There is disposed in the bottom portion of the image forming apparatus 100, a cassette 9, in which sheets of recording medium are stored. Further, the image forming apparatus 100 is provided with a manual sheet feeding tray 10, which is attached to the outward side of one of the side walls of the apparatus main assembly 100A. As a sheet of recording medium is fed into the apparatus main assembly 100A from the cassette 9 or manual sheet feeder tray 10, it is conveyed toward the pair of registration rollers 12 by a pair of conveyance rollers 11*a* or 11*b*, respectively. With respect to the recording medium conveyance direction, the pair of registration rollers 12 function also as a pair of conveyance rollers which are disposed next to the upstream side of the secondary transferring portion T2. As the sheet of recording medium comes into contact with the pair of registration rollers 12 by its leading edge while the registration rollers 12 are remaining stationary, it bends in curvature, being thereby corrected by itself in attitude if it happens to be askew. Then, the rotation of the pair of registration rollers 12 is started with such timing that the sheet will arrive at the secondary transferring portion T2 at the same time as the toner image on the intermediary transfer belt 121. Thus, the sheet is conveyed to the secondary transferring portion T2 by way of a recording medium conveyance passage 14 made up of the pre-transfer guide 13, etc. In this embodiment, the pair of registration rollers 12 are equivalent to the sheet conveying means which is capable of conveying a sheet of recording medium to the secondary transferring portion T2.

Next, the process through which a full-color image is formed by the image forming apparatus 100 structured as described above, based on the four primary colors, is described. As an image forming operation is started, first, the photosensitive drum 3*a* begins to be rotated, and the peripheral surface of the rotating photosensitive drum 3*a* is uniformly charged by the charging apparatus 5*a*. Then, the photosensitive drum 3*a* is exposed by to the beam of laser light emitted by the exposing apparatus 6*a* while being modulated by image formation signals. As a result, an electrostatic latent image, which reflects the image formation signals, is effected on the peripheral surface of the photosensitive drum 3*a*. The electrostatic latent image on the photosensitive drum 3*a* is developed into a visible image, or a toner image, by the toner stored in the developing apparatus 7*a*.

Then, the toner image on the photosensitive drum 3*a* is transferred (primary transfer) onto the intermediary transfer belt 121, in the primary transferring portion T1*a* which is formed between the peripheral surface of the photosensitive drum 3*a* and that of the primary transfer roller 8*a*, with the presence of the intermediary transfer belt 121 between the photosensitive drum 3*a* and primary transfer roller 8*a*. While the sheet of recording medium is conveyed through the primary transferring portion T1, the primary transfer bias is continuously applied to the primary transfer roller 8*a*. The toner (transfer residual toner) which is remaining on the peripheral surface of the photosensitive drum 3*a* after the primary transfer is removed by the cleaning apparatus 4*a*.

The above-described process is sequentially carried in the image forming portions 2*a*, 2*b*, 2*c* and 2*d*, which form yellow, magenta, cyan and black toner images, respectively, so that the four toner images, different in color, are transferred in layers onto the intermediary transfer belt 121. Then, one of the sheets S of recording medium stored in the cassette 9, or placed on manual feeder tray 10, is conveyed to the secondary transferring portion T2 in synchronism with the formation of the toner images. Then, the four toner images, different in color, on the intermediary transfer belt 121 are transferred together (secondary transfer) by the application of a combination of a preset amount of pressure and a present amount of electrostatic load bias (secondary transfer bias). The toner which failed to be transferred in the intermediary transferring portion T2, and therefore, is remaining on the intermediary transfer belt 121, is removed by an intermediary transfer belt cleaner 125.

Then, the sheet S of recording medium is conveyed to the fixing apparatus 15 which is a fixing means. The fixing apparatus 15 is equipped with a fixation roller 15*a* and a pressure roller 15*b*. It forms a fixation nip between the fixation roller 15*a* and pressure roller 15*b*. After the transfer of the toner images onto the sheet S, the sheet S is conveyed through this fixation nip of the fixing apparatus 15. While the sheet S is conveyed through the fixation nip, the sheet S and the toner images thereon are heated and pressed. Thus, the toner on the sheet S melts and mixes. Then, as the mixture of the toner cools, it becomes fixed to the sheet S. Thereafter, the sheet S is discharged into a delivery tray 17 by a pair of discharge rollers 16, ending the image formation process.

By the way, in a case where an image is formed on both surfaces of a sheet S of recording medium, the sheet S is conveyed to a sheet conveyance passage 18 for the two-sided image formation mode, after the formation of an image on one of two surfaces of the sheet S. Then, the sheet S is conveyed to the secondary transferring portion T2 for the second time so that an image is formed on the other surface of the sheet S.

[Apparatus Adjustment]

The image forming apparatus 100 is provided with a sensor unit 200, which is disposed between the image forming portion 2*d* and secondary transferring portion T2 in such a manner that it faces the surface of the intermediary transfer belt 121. The sensor unit 200 has the first and second sensors 201 and 202, which are enabled to detect the toner image on the intermediary transfer belt 121, as will be described later. With respect to the direction in which the intermediary transfer belt 121 is rotated, the sensor unit 200 is disposed on the downstream side of the primary transferring portion T1, and on the upstream side of the secondary transferring portion T2. The positioning of the sensor unit 200 is described later in detail.

The sensor unit 200 is provided with three sensors, more specifically, a pair of the first sensors 201, and one second sensor 202. With respect to the direction which is perpendicular to the direction in which the intermediary transfer belt 121 is rotated, these sensors 201 and 202 are evenly distributed (FIG. 4). They detect the four monochromatic control toner images, different in color, formed on the intermediary transfer belt 121 for adjusting the image forming apparatus 100 in the color and density of the images it forms (these images may be referred to as "control images", hereafter). The control portion 300 of the image forming apparatus 100 adjusts (corrects) the image forming apparatus 100, with regard to the chromatic deviation, density deviation, etc., of each monochromatic control toner image.

By the way, the control portion 300 is provided with a CPU (central processing unit) and a memory unit, which has a ROM (Read Only Memory) and a RAM (Random Access Memory). In the ROM, programs and the like, which correspond to control procedures, are stored. The image forming apparatus 100 is structured so that the CPU controls each of its sections while reading the programs stored in the ROM. In the RAM, operational data and input data are stored. The image forming apparatus 100 is structured so that its CPU controls the operation of the image forming apparatus 100 based on the abovementioned programs, with reference to the data stored in the RAM.

The process for adjusting (correcting) the image forming apparatus 100 in the color of the images it forms is as follows. First, the control portion 300 forms control toner images, different in color, on the intermediary transfer belt 121 with preset timing. Then, it detects the control toner images with the use of the first and second sensors 201 and 202. More concretely, first, the exposing apparatuses 6*a*-6*d* form four electrostatic latent images, which correspond to the four control toner images, different in color, on the peripheral surfaces of the photosensitive drums 3*a*-3*d*, one for one. The formed electrostatic latent images are developed into control toner images, different in color, by the developing apparatuses 7*a*-7*d*, one for one. Then, the toner images on the photosensitive drums 3*a*-3*d* are sequentially transferred (primary transfer) onto the intermediary transfer belt 121 by the combination of the preset amount of pressure and the preset amount of electrostatic load bias applied by the primary transfer rollers 8*a*-8*d*. After the transfer (primary transfer) of the control toner images onto the intermediary transfer belt 121, they are detected by the first and second sensors 201 and 202. The information regarding the detected control toner images is processed by the control portion 300. That is, the control portion 300 calculates the amount of color deviation of each control toner image and the amount of density deviation of each control toner image. Then, it adjusts the image forming apparatus 100 in the color and density of the images the apparatus 100 will form (feedback), based on the calculated amount of color deviation and density deviation.

That is, the control portion 300 calculates the amount of the positional deviation of each of the control images other than the yellow control image, that is, the control image of the referential color formed in the image forming portion 2*a*, or the most upstream image forming portion, relative to the position of the yellow control image. Then, the control portion 300 adjusts the image forming apparatus 100 in the point in each image forming portion 2, at which the exposure process is started by the exposing apparatus, in order to ensure that the four monochromatic toner images, different in color, will be transferred onto the intermediary transfer belt 120 in layers, in satisfactory alignment. Among the three sensors which are different in position, the second sensor 202 or the central sensor, doubles as a sensor for detecting the density of each control toner image. That is, the control portion 300 calculates the amount by which the image forming apparatus 100 is to be adjusted in the density of the control toner images, different in color, based on the results of the detection by the second sensor 202. For example, it adjusts the image forming apparatus 100 in the density of each of the four monochromatic toner images, different in color, by adjusting the amount by which each photosensitive drum 3 is to be exposed by the exposing apparatus, the bias to be applied to the developing apparatus during the developing process, etc., or the like factor.

[First and Second Sensors]

Next, referring to part (a) of FIG. 2 and part (b) of the Figure, the first and second sensors 201 and 202 of the sensor unit 200 are described. The first sensor 201 is an optical sensor. It has a casing 203, a light source 204, a light catching portion 205 (which is for catching nondiffusively reflected light), a substrative plate 206, and a sensor cover 207. By the way, part (a) of FIG. 2 is a perspective view of the first sensor 201, and shows the internal structure of the portion of the sensor 201 encircled by a dotted line in the drawing. Part (b) of FIG. 2 is also a schematic perspective view of the first sensor 201, and shows the internal structure of the portion of the sensor 201 encircled by a dotted line. Part (a) of FIG. 3 and part (b) thereof are similar to part (a) of FIG. 2 and part (b) thereof, respectively.

The light source 204 (which in this embodiment is LED) is disposed within the casing 203. The light catching portion 205 (which in this embodiment is photo-diode) catches the light which was emitted by the light source 204 and non-diffusively reflected by the intermediary transfer belt 121. The substrative plate 206 is where the light source 204 and light catching portion 205 are mounted. The sensor cover 207 is formed of a transparent substance (which in this embodiment is acrylic plate) which is also the material for a condensing lens. By the way, the sensor cover 207 is disposed so that it is perpendicular to the surface of the substrative plate 206, across which the light source 204 and light catching portion 205 are mounted. That is, the sensor cover 207 is disposed so that after the attachment of the sensor unit 200 to the apparatus main assembly 100A, the sensor cover 207 is roughly parallel to the surface of the intermediary transfer belt 121. In this embodiment, the distance between the sensor cover 207 and the surface of the intermediary transfer belt 121 was set to roughly 6 mm.

As for the second sensor 202, it is also an optical sensor. It is similar in structure to the first sensor 201, except that it is provided with a light catching portion 208, which is also mounted on the substrative plate 206 in the casing 203. The light catching portion 208 is such a portion that catches the light which was emitted by the light source 204 and was diffusively reflected by the intermediary transfer belt 121. Since the second sensor 202 is the same in structure as the first sensor 201 except that it has the light catching portion 208, the members of the second sensor 203, which are equivalent to the counterparts of the first sensor 201, are given the same referential codes, and are not described here. By the way, the distance between the sensor cover 207 of the second sensor 202 and the surface of the intermediary transfer belt 121 was also set to roughly 6 mm. As described above, the first sensors 201 detects the position and density of each control toner image by detecting the light emitted from the light source 204 and nondiffusively reflected by the surface of the intermediary transfer belt 121, whereas the second sensor 202 detects the position of each control toner image on the intermediary transfer belt 121 by detecting the light emitted from the light source 204 and diffusively reflected by the surface of the intermediary transfer belt 121.

[Positioning of Sensor Unit]

Figure 1:
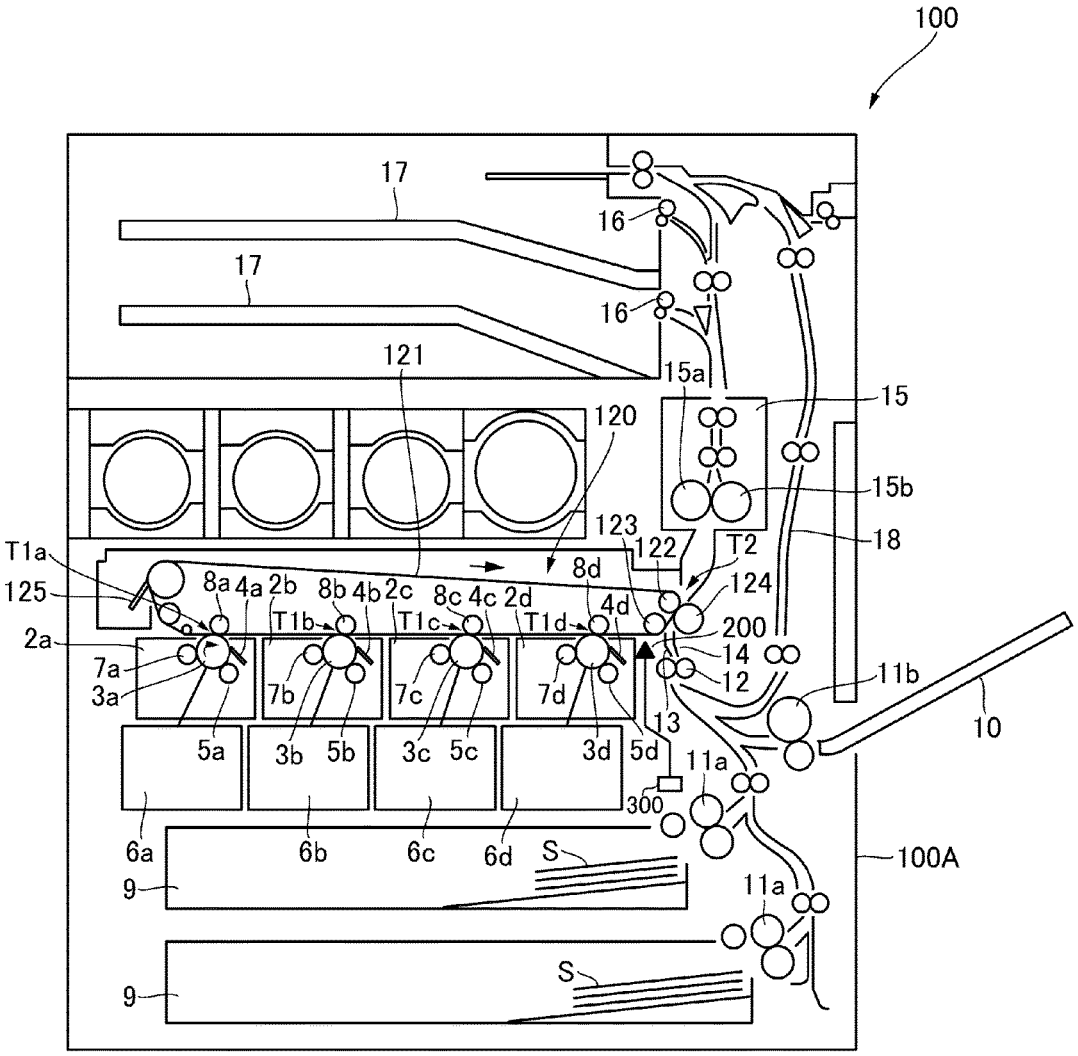
FIG. 1 is a schematic sectional view of the image forming apparatus in one of the preferred embodiments of the present invention; it shows the general structure of the apparatus.

Next, referring to FIG. 1 and parts (a)-(f) of FIG. 3, the positioning of the sensor unit 200 is described. Referring to FIG. 1, the image forming apparatus 100 in this embodiment is of the so-called vertical conveyance type. That is, it is structured so that sheets S of recording medium are conveyed upward from the cassette 9 which is in the bottom portion of the apparatus main assembly 100A. Thus, the secondary transferring portion T2 is above the pair of registration rollers 21, and the sensor unit 200 is positioned next to (as seen from horizontal direction) the recording medium conveyance passage 14 through which the sheets S of recording medium are conveyed to the secondary transferring portion T2 from the pair of registration rollers 12. In other words, the sensor unit 200 is disposed so that as the image forming apparatus 100 is seen from the direction which is horizontal and perpendicular to the recording medium conveyance direction, the sensor unit 200 overlaps with the recording medium conveyance passage 14.

In particular, referring to part (a) of FIG. 3, the sensor unit 200 is disposed so that the length L1 of the portion of the intermediary transfer belt 121 between the secondary transferring portion T2 and the sensor unit 200 becomes no more than the dimension of the largest sheet of recording medium, with respect to the recording medium conveyance direction, on which an image can be formed by the image forming apparatus 100. For example, in a case where a sheet of recording medium of size A3, that is, the largest sheet of recording medium on which an image can be formed by the image forming apparatus 100, is conveyed in the portrait mode, the dimension of the sheet in terms of the recording medium conveyance direction is 420 mm. Thus, the sensor unit 200 is positioned so that the dimension L1 become no more than 420 mm.

Preferably, the sensor unit 200 is disposed so that the length L1 becomes no more than the measurement of the smallest sheet of recording medium, in terms of the recording medium conveyance direction, on which an image can be formed by the image forming apparatus 100. For example, in a case where an envelop, which is the smallest recording medium on which an image can be formed by the image forming apparatus 100, is conveyed in the landscape mode, the measurement of the medium is 98.4 mm. Thus, it is desired that the sensor unit 200 is disposed so that the length L1 becomes no more than 98.4 mm. In this embodiment, the sensor unit 200 was disposed so that the length L1 becomes roughly 32.4 mm.

By the way, the position described in this specification as the position in which the sensor unit 200 is disposed is an area which corresponds in position to the portion of the intermediary transfer belt 121, which is illuminated by the light source 204 of the sensor unit 200. Further, the distance, in terms of the recording medium conveyance direction, from the sensor unit 200 to the secondary transferring portion T2 means the distance from the sensor unit 200 to the center of the secondary transferring portion T2, or the recording medium sandwiching nip between the intermediary transfer belt 121 and secondary transfer outside roller 124. Moreover, the lengthwise measurement of a sheet of recording medium means the measurement of the sheet P in terms of the recording medium conveyance direction. Further, the widthwise measurement of a sheet of recording medium means the measurement of the sheet in terms of the direction which is perpendicular to the recording medium conveyance direction.

To describe the positioning of the sensor unit 200 in greater detail, with respect to the distance, measured along the surface of the intermediary transfer belt 121, between the first transferring unit T1*d*, and the secondary transferring section T2, the sensor unit 200 is disposed closer to the secondary transferring portion T2 than to the first transferring portion T1*d*. More concretely, the distances of the sensor unit 200 from the points of the image forming apparatus 100, which are related to the present invention, are as follows.

To begin with, referring to part (b) of FIG. 3, with respect to the recording medium conveyance direction, L2 stands for the measurement of the portion of a sheet S of recording medium, which is between the nip of the secondary transferring portion T2 and that of the pair of registration roller 12, and which remains bent in curvature by an amount large enough to come into contact with the secondary transferring portion front guide 13. In this case, the image forming apparatus 100 is structured so that "L1≤≤L2" is satisfied. That is, the image forming apparatus 100 is structured so that L1 is no more than L2, that is, the measurement of the portion of a sheet S of recording medium, which is between the center of the nip of the secondary transferring portion T2 and that of the pair of registration rollers 12 when the amount by which the sheet S bends in curvature is largest. In this embodiment, the image forming apparatus 100 is structured so that L3 becomes roughly 49.4 mm.

Next, referring to part (c) of FIG. 3, L3 stands for the rectilinear distance between the center of the nip (which nips sheet of recording medium) of the secondary transferring portion T2, in terms of the recording medium direction, and the center of the nip (which nips sheet of recording medium) of the pair of registration roller 12. In this case, the image forming apparatus 100 is structured so that "L1≤L3" is satisfied. That is, L1 is no more than the rectilinear distance between the pair of registration roller 12 and the secondary transferring portion T2. In this embodiment, the image forming apparatus 100 was structured so that L3 becomes rough 45.4 mm.

Next, referring to part (d) of FIG. 3, L4 stands for the rectilinear distance between the center of the secondary transfer inside roller 122 and that of the secondary transfer front roller 123. Further, referring to part (e) of FIG. 3, L5 stands for the distance from the sensor unit 200 to the primary transferring portion T1*d*. By the way, "to the primary transferring portion T1*d*" means to the intersection between the surface of the intermediary transfer belt 121 and the straight line which coincides with the center of the photosensitive drum 3*d* and is perpendicular to the surface of the intermediary transfer belt 121. Moreover, referring to part (f) of FIG. 4, L6 stands for the distance from the sensor unit 200 to the secondary transfer front roller 123. By the way, "to the secondary transfer front roller 123" means to the intersection between the surface of the intermediary transfer belt 121, and the straight line which coincides with the center of the second transfer front roller 123 and is perpendicular to the surface of the intermediary transfer belt 121.

In this case, the image forming apparatus 100 is structured so that "L6<L5" is satisfied. Further, it is preferred that the image forming apparatus 100 is structured so that "L6<L4" is satisfied. That is, it is desired that the image forming apparatus 100 is structured so that L6, or the distance from the sensor unit 200 to the center of the secondary transfer front roller 123, is shorter than L4, or the distance between the center of the secondary transfer inside roller 122 and that of the secondary transfer front roller 123. In this embodiment, the image forming apparatus 100 is structured so that L6 becomes roughly 19.2 mm; L5, roughly 43.8 mm; and L6 becomes roughly 3.8 mm.

That is, in this embodiment, the sensor unit 200 is disposed as close as possible to the secondary transfer front roller 123, for the following reason. That is, if the surface of the intermediary transfer belt 121 is detected by the sensor unit 200, in an area which is not in the adjacencies of the area of contact between the intermediary transfer belt 121 and second transfer front roller 123, it is possible that the fluttering of the intermediary transfer belt 121 will reduce the sensor unit 200 in accuracy. In this embodiment, therefore, the sensor unit 200 is disposed so that it opposes the portion of the intermediary transfer belt 121, which is in contact with the secondary transfer front roller 123, or as close as possible to this portion of the intermediary transfer belt 121, in order to minimize the amount by which the sensor unit 200 is reduced in accuracy by the fluttering of the intermediary transfer belt 121.

[Structure of Sensor Unit]

Next, referring to parts (a) and (b) of FIG. 4, the structure of the sensor unit 200 is described. The sensor unit 200 is made up primarily of a frame 209, a sensor holder 210, a protective shutter 211, and a shutter moving mechanism 212, in addition to the above-described first and second sensors 201 and 202.

The frame 209 is a holding member. It is the base of the sensor unit 200. It is roughly rectangular, and is disposed so that its longer edges are perpendicular to the rotational direction of the intermediary transfer belt 121. It has a side wall 209*a*, and a pair of positioning portions 213*a* and 213*b*, which are the lengthwise end portions of the side wall 209*a*, one for one. The side wall 209*a* holds the first and second sensors 201 and 202, with the placement of a sensor holder 210 between itself and the sensors 201 and 202. It is disposed so that it is on the opposite side of the first and second sensors 201 and 202 from the recording medium conveyance passage 14. That is, the sensor holder 210 is where the first and second sensors 201 and 202 are fixed. That is, the first and second sensors 201 and 202 are attached to the sensor holder 210, and the sensor holder 210 is attached to the side wall 209*a*, whereby the first and second sensors 201 and 202 are held by the frame 209. The positioning portions 213*a* and 213*b* are attached to parts of the frame of the apparatus main assembly 100A (FIG. 1), whereby the sensor unit 200 is disposed in a preset location in the apparatus main assembly 100A.

The sensor unit 200 is disposed in such an attitude that it squarely faces the surface of the intermediary transfer belt 121, that is, the detection surface 201*a* and 202*a* of the first and second sensors 201 and 202, respectively, are roughly parallel to the surface of the intermediary transfer belt 121. Further, the sensor unit 200 is disposed so that its detection surfaces 201*a* and 202*a* face upward. Further, it is disposed so that the distance between the surface of the intermediary transfer belt 121 and the detection surface 201*a* of the first sensor 201, and the distance between the surface of the intermediary transfer belt 121 and the detection surface of the sensor 202*a*, remain stable. By the way, "detection surfaces 201*a* and 202*a*" means two parts, one for one, of surface of the sensor cover 207 (through which control toner images are detected) which covers the first and second sensors 201 and 202.

Further, the sensor unit 200 is disposed so that its lengthwise direction is parallel to the widthwise direction, which is perpendicular to the rotational direction of the intermediary transfer belt 121. Further, it is disposed so that, with respect to the widthwise direction of the intermediary transfer belt 121, the second sensor 202 faces the center portion of the intermediary transfer belt 121, and the pair of first sensors 201 face the edge portions of the intermediary transfer belt 121, one for one. By the way, this embodiment is not intended to limit the present invention in terms of the number and positioning of the first and second sensors 201 and 202. That is, the numbers and positioning of the first and second sensors 201 and 202 are optional.

The protective shutter 211 is a covering member. It is disposed so that it is between the first sensor 201 and intermediary transfer belt 121, and also, between the second sensor 202 and intermediary transfer belt 121, and also, so that it can be placed in the first or second position. It protects the sensor cover 207 for the first and second sensor 201 and 202. Since the detection surfaces 201*a* and 202*a* of the first and second sensor 201 and 202, respectively, face upward, the protective shutter 211 is disposed above both the first and second sensors 201 and 202. The direction in which the protective shutter 211 is movable is parallel to the lengthwise direction of the sensor unit 200.

The protective shutter 211 is provided with a pair of detection holes 216*a*, which correspond to the pair of first sensors 201, one for one, and one detection hole 216*b* which corresponds to the second sensor 202. It is when the protective shutter 211 is in the first position that the protective shutter 211 exposes the detection surfaces 201*a* and 202*a* of the first and second sensors 201 and 202 through its detection holes 216*a* and 216*b*, respectively. The image forming apparatus 100 is structured so that when the protective shutter 211 is in the first position, the toner images on the intermediary transfer belt 121 (intermediary transferring member) can be detected by the first and second sensors 201 and 202, whereas when the protective shutter 211 is in the second position, its covering portion 211*a*, that is, the portion which does not have the detection holes 216*a* and 216*b*, covers the detection surfaces 201*a* and 202*a* of the first and second sensors 201 and 202, respectively.

The shutter moving mechanism 212 can move the protective shutter 211 to the first or second position. That is, it can move the protective shutter 211 to the position where the detection surfaces 201*a* and 202*a* are exposed through the detection holes 216*a* and 216*b*, or the position where the detection surfaces 201*a* and 202*a* are covered with the covering portion 211*a* of the protective shutter 211.

[Shutter Moving Mechanism]

Next, referring to parts (a) and (b) of FIG. 5, the above-mentioned shutter moving mechanism 212 is described. Part (a) of FIG. 5 shows the combination of the solenoid 214, shutter moving mechanism 212, and protective shutter 211 when the protective shutter 211 is open (top), and that when the protective shutter 211 is closed (bottom). It is for showing the distance the protective shutter 211 is moved. The top side of the drawing shows the protective shutter 211 when the shutter 211 is open, and the bottom side shows the protective shutter 211 when the shutter 11 is closed. The shutter moving mechanism 212 has the solenoid 214 as a driving force source, and a linkage 215. As the solenoid 214 is driven by the control portion 300, the protective shutter 211 is moved in the lengthwise direction of the solenoid 214 by the solenoid by way of the linkage 215. For example, as the solenoid 214 is turned on (supplied with electric power), the protective shutter 211 moves to its first position in which it keeps the protective shutter 211 open as the bottom side of part (a) of FIG. 5 shows. On the other hand, as the solenoid 214 is turned off (not supplied with electric power), the protective shutter 211 moves to its second position in which it keeps the protective shutter 211 closed as shown in the bottom side of part (a) of FIG. 5. By the way, the relationship between the state (on or off) of the solenoid 214 and the position of the protective shutter 211 may be opposite from the above-described one.

As described above, the protective shutter 211 is movable by the shutter moving mechanism 212 to its first position in which it remains open, or its second position in which it remains closed. The process to be carried out with preset timing to adjust (correct) the image forming apparatus 100 in image properties is as follows. First, the control portion 300 drives the shutter moving mechanism 212 to move the protective shutter 211 to the first position to open the protective shutter 211 so that the detection holes 216*a* and 216*b* move to positions in which they align with (expose) the detection surfaces 201*a* and 202*a* of the first and second sensors 201 and 202, that is, parts of the top surface of the sensor cover 207. Thus, the light emitted from the light sources 204 of the first and second sensors 201 and 202 is focused on the surface of the intermediary transfer belt 121 through the sensor cover 207 and detection holes 216*a* and 216*b*, and reflected by the surface the intermediary transfer belt 121. As the light is reflected by the surface of the intermediary transfer belt 121, it travels through the detection holes 216*a* and 216*b* and the sensor cover 207, and is caught by the light catching portion 205 for catching (sensing) the portion the light, which was diffusively reflected by the surface of the intermediary transfer belt 121, and the light catching portion 208 for catching (sensing) the portion of the light, which was diffusively reflected by the surface of the intermediary transfer belt 121. That is, the first and second sensors 201 and 202 detect the control toner images on the intermediary transfer belt 121 so that the control portion 300 can adjust (correct) the image forming apparatus 100 in image properties (color, density, etc.).

On the other hand, as the process for adjusting (correcting) the image forming apparatus 100 in image properties is ended, the shutter moving mechanism 212 is driven by the control portion 300 to move the protective shutter 211 to the second position to close the shutter 211. As the protective shutter 211 is moved to its second position, the covering portion 211*a* of the protective shutter 211, or the portions which are not the detection holes 216*a* and 216*b*, covers the portions of the top surface of the sensor cover 207, which correspond in position to the first and second sensors 201 and 202. Thus, it is unlikely for foreign particles such as toner particles and paper duct to adhere to the surface of the sensor cover 207.

[Adhesion of Foreign Substances (Contaminants) to Sensor Unit]

When the protective shutter 211 is closed, the detection holes 216*a* and 216*b* are not in alignment with the portions of the sensor cover 207, which correspond in position to the first and second sensors 201 and 202, respectively. Thus, it sometimes occurs that foreign substances (contaminants) accumulate on the areas in the sensor unit 200, which are below the detection holes 216*a* and 216*b*, but, are not directly below the portions of the sensor cover 207, which correspond in position to the first and second sensors 201 and 202.

In particular, in this embodiment, the sensor unit 200 is disposed close to the secondary transferring portion T2, and also, as close as possible to the secondary transfer front roller 123 as described above. Therefore, the sensor unit 200 is disposed close to the recording medium conveyance passage 14 for conveying a sheet S of recording medium to the secondary transferring portion T2, as shown in FIG. 6.

Thus, as a sheet S of recording medium reaches the secondary transferring portion T2, the recording medium conveyance passage side of the sensor unit 200 is blocked by the sheet S and recording medium conveyance passage 14, which is made up of the transferring portion front guide 13, etc. Here, the airflow A which is generated by the rotational movement of the intermediary transfer belt 121 moves rightward of FIG. 6, as seen from the front side of the apparatus main assembly 100A, and collides with the sheet S and/or the conveyance passage 14. Therefore, the airflow A is directed backward toward the sensor unit 200 as indicated by an arrow mark in FIG. 6.

Thus, the foreign substances (contaminants) such as paper dust and stray toner particles which are generated as a sheet S of recording medium rubs against rollers and recording medium conveyance passages 14 while the sheet S is conveyed, are likely to flow back toward the sensor unit 200 and adhere to the sensor unit 200. In particular, in recent years, image forming apparatuses have been substantially reduced in size, and therefore, in internal space. Consequently, they have been reduced in the distance from the sensor unit 200 to the secondary transferring portion T2. As an image forming apparatus is reduced in this distance, it is also reduced in the distance from the sensor unit 200 to the recording medium conveyance passage 14, and the distance from the sensor unit 200 to the sheet S which is being conveyed through the conveyance passage 14. Therefore, it has become more likely for the foreign substances (contaminants) to adhere to the sensor unit 200 as they are carried by the airflow A than in the past. That is, in the case of the current crop of image forming apparatuses, it is more likely for the foreign substances (contaminants) to adhere to the detection surface 201*a* of the first sensor 201 and the detection surface 202*a* of the second sensor 202 than in the past.

Next, referring to parts (a) and (b) of FIG. 7, the above-described concern is addressed in detail, assuming, first, that the image forming apparatus does not have slots 217 and a blocking portion 218. Incidentally, although parts (a) and (b) of FIG. 7 show only the relationship in position between the detection surface 202*a* of the second sensor 202, and the detection hole 216*b*, the relationship in position between the detection surface 201*a* of the first sensor 201, and the detection hole 216*a*, is the same as that of the detection surface 202*a* and detection hole 216*a*.

Referring to part (a) of FIG. 7, when the protective shutter 211 is remaining closed, the detection surfaces 201*a* and detection surface 202*a* of the first and second sensors 201 and 202, respectively, remain covered by the covering portion 211*a*. Therefore, it is unlikely for the foreign substances (contaminants) to adhere to the detection surfaces 201*a* and detection surface 202*a*. However, it sometimes occurs that as foreign substances (contaminants) are borne by the airflow A, they go through the detection holes 216*a* and 216*b*, and accumulate on the areas below the detection holes 216*a* and 216*b*.

Referring to part (b) of FIG. 7, if the protective shutter 211 is moved to its first position to be closed, while the foreign substances (contaminants) having accumulated on the areas below the detection holes 216*a* and 216*b* are still there, the foreign substances (contaminants) are carried by the protective shutter 211. When the protective shutter 211 is in the first position, the detection holes 216*a* and 216*b* align with the detection surfaces 201*a* and detection surface 202*a* of the first and second sensors 201 and 202, respectively. Therefore, it is possible that the foreign substances (contaminants) will be carried by the protective shutter 211, and be positioned in a manner to face the detection surfaces 201*a* and 202*a* . In this embodiment, therefore, the image forming apparatus 100 is structured as follows to minimize the amount by which the detection surfaces 201*a* and 202*a* are soiled by these foreign substances (contaminants).

[Slots of Frame]

The first and second sensors 201 and 202 are disposed between the side wall 209*a* of the sensor unit 200, and the recording medium conveyance passage 14 through which a sheet of recording medium is conveyed from the pair of registration rollers 12 to the secondary transferring portion T2. In other words, they are disposed on the bottom side of the airflow A which was bounced back from the recording medium passage 14, in the sensor unit 200. In this embodiment, therefore, the side wall 209*a* is provided with three slots 217, which are located so that when the protective shutter 211 is in its second position, they align with the detection holes 216*a* and 216*b*. The frame 209 is structured so that the bottom edge of each slots 217 is positioned lower than the bottom surface protective shutter 211, and also, so that the bottom surface (edge) 217*a* of the slot is positioned lower than the top edge of the portions of the side wall 209*a*, which correspond in position to the detection surfaces 201*a* and detection surface 202*a*. That is, with respect to the direction of the movement of the protective shutter 211, the bottom surface (edge) 217*a* of each slot 217 is positioned lower than the portions of the side wall 209*a*, which correspond in position to the detection surfaces 201*a* and 202. In this embodiment, the frame 209 is structured so that when the protective shutter 211 is in its second position (closed), the slots 217 align with the detection holes 216*a* and 216*b*. That is, the frame 209 is structured as if the portions of the side wall 209*a*, which correspond in position to the detection holes 216*a* and 216*b* when the protective shutter 211 is remaining closed, were cut out downward from their top side. By the way, this embodiment is not intended to limit the present invention, regarding how the slots are made. That is, the method for providing the frame 209 with the slots 207 does not need to be limited to the one that cuts parts of the frame 209 away. For example, instead of subjecting the precursor of the frame 209 to the secondary process of cutting, the material for the frame 209 may be punched out so that the precursor will be provided with the slots through the first process of punching.

As described above, in this embodiment, the frame 209 is structured so that the side wall 209*a*, or the downstream side wall in terms of the direction in which the airflow A is bounced back, is provided with the slots 217. Therefore, when the protective shutter 211 is remaining closed, as the foreign substances (contaminants) enter the sensor unit 200 through the detection holes 216*a* and 216*b* by being carried by the airflow A, they fall out of the sensor unit 200 through the slots 217. Therefore, the image forming apparatus 100 in this embodiment is significantly smaller in the amount by which foreign substances (contaminants) accumulate on the area below the detection holes 216*a* and 216*b*.

Further, the image forming apparatus 100 in this embodiment is structured so that the distance between the bottom surface (edge) 217*a* of each slot 217 and the protective shutter 211 is no less than the distance between the protective shutter 211 and detection surfaces 201*a* and 202*a*. That is, it is structured so that the height of the slot 217 is no less than the distance from the protective shutter 211 to the detection surfaces 201*a* and detection surface 202*a*. Incidentally, it is preferred that, in terms of the moving direction of the protective shutter 211, the length of the slot 217 is no less than the length of the detection holes 216*a* and 216*b*. By structuring the image forming apparatus 100 so that the height and length of the slot 217 becomes as described above, it is possible to ensure that the foreign substances (contaminants) having passed through the detection holes 216*a* and 216*b* are easily discharged through the slot 217.

However, the image forming apparatus 100 is to be structured so that, in terms of the moving direction of the protective shutter 211, the slots 217 do not overlap with the detection surfaces 201*a* and 202*a* of the first and second sensors 201 and 202, respectively, in order to prevent the problem that the foreign substances (contaminants) having passed through the detection holes 216*a* and 216*b* adhere to the detection surfaces 201*a* and 202*a* when they are discharged through the slots 217.

By the way, the image forming apparatus 100 is structured so that the side wall 209*a* is on the opposite side of the first and second sensors 201 and 202 from the recording medium conveyance passage 14. However, there is no requirement regarding the recording medium conveyance passage side of the side wall 209*a*. It depends of the strength or the like of the side wall 209*a*. In this embodiment, the image forming apparatus 100 is structured so that in terms of the moving direction of the protective shutter 211, each slot 207 is longer than the detection holes 216*a* and 216*b*, and both edges of the slot 207 are on the outward side of the edges of the corresponding detection hole 201*a* and detection surface 202*a*, respectively. With respect to the moving direction of the protective shutter 211, each slot 217 may overlap with the substrative plate 206 for the first and second sensors 201 and 202, as long as they do not overlap with the detection surfaces 201*a* and detection surface 202*a*. In the case of the example shown in FIG. 7, the image forming apparatus 100 is structured so that the slots 217 do not overlap with the substrative plate 206.

Since the side wall 209*a* is provided with the slots 217, foreign substances (contaminants) are discharged through the slots 217 as they enter the sensor unit side of the sensor unit 200 through the slots 217. Therefore, it is unlikely for the foreign substances (contaminants) to accumulate on the areas below the detection holes 216*a* and 216*b* when the protective shutter 211 is in the second position. Therefore, it is possible to reduce the image forming apparatus 100 in the amount by which the foreign substances (contaminants) are carried to the sensor unit 200 by the airflow A when the protective shutter 211 is moved to its first position to be opened to enable the first and second sensors 201 and 202 to detect the control toner images. That is, this embodiment can make it unlikely for foreign substances (contaminants) to adhere to the detection surfaces 201*a* and detection surface 202*a*.

[Blocking Portion]

Next, referring to part (a) of FIG. 7, there are provided blocking portions 218 which will be between the detection holes 216*a* and 216*b* and the first and second sensors 201 and 202, respectively, when the protective shutter 211 is in its second position. The blocking portion 218 is disposed in a space 219 which is between the protective shutter 211 and the first sensor 201 and between the protective shutter 211 and second sensor 202. With respect to the moving direction of the protective shutter 211, the blocking portion 218 at least partially blocks the portion of the space 219, which is between the detection hole 216*a* and detection surface 201*a*, and the portion of the space 219, which is between the detection hole 216*a* and the detection surface detection surface 202*a*. In this embodiment, the blocking portion 218 is a protrusion which protrudes into (downward) the space 19 from the protective shutter 211. By the way, the blocking portion 218 does not need to a part of the protective shutter 211. For example, it may be formed as a part of the frame 209 or sensor holder 210 so that it protrudes into (upward) the space 219 from the frame 209 or sensor holder 210, respectively.

In this embodiment, the sensor unit 200 is provided with the blocking portions 218 as described above. Therefore, it is unlikely for foreign substances (contaminants) to enter the sensor unit 200 through the detection holes 216*a* and 216*b*, and then, enter where the detection surfaces 201*a* and detection surface 202*a* of the first and second sensors 201 and 202, respectively, are present. That is, this embodiment makes it unlikely for foreign substances (contaminants) to adhere to the detection surfaces 201*a* and detection surface 202*a*.

[Confirmation of Effects of this Embodiment]

Next, referring to FIGS. 8 and 9, the experiments conducted to confirm the effectiveness of this embodiment are described. FIG. 8 is a graph which shows the relationship among multiple conditions under which the image forming apparatus 100 was operated, cumulative number of sheets of recording medium conveyed through the secondary transferring portion T2 (cumulative sheet count), and amount (%) of power inputted into the LEDs as a light sources 204 of the first and second sensors 201 and 202. That is, the horizontal axis of FIG. 8 represents the cumulative number of the sheets of recording medium conveyed through the secondary transferring portion T2, and the vertical axis of FIG. 8 represents the amount (% relative to initial amount) by which electrical current was flowed to keep the output of the light catching portion 205 for the nondiffusively reflected light, stable at a preset level as the light catching portion 205 catches the light emitted by the light source (LED) and reflected by the surface of the intermediary transfer belt 121. FIG. 8 shows the changes in the amount (%) of power inputted into the LED, relative to the initial amount.

That is, as foreign substances (contaminants) adhere to the detection surfaces 201*a* and 202*a* of the first and second sensors 201 and 202, respectively, the amount by which light can be caught by the light catching portions 205 for catching the nondiffusively reflected light. Thus, in order to keep the output voltage of the light catching portion 205 stable at a preset level, the light source 204 is increased in the amount of the light it emits. That is, the LED is increased in the amount of power input. Thus, the smaller the LED in input value, the smaller the amount of the foreign substances (contaminants) on the detection surfaces 201*a* and detection surface 202*a*. In this embodiment, the initial value of the amount by which light source was provided with electric current was roughly 9 mA, and the maximum amount by which the light source was provided with electric current was 18.7 mA.

In these experiments, the light source 204 (LED) was adjusted in the amount by which it was supplied with power in such a manner that the output (background light amount) of the light catching portion 205 remains at 2.3 V as the light nondiffusively reflected by the surface of the intermediary transfer belt 121 is caught by the light catching portion 205. If the amount of the background light is no more than 2.3 V, it is impossible to detect the difference between the output of the light catching portion 205 and the amount of the background light. That is, the sensors becomes lower in accuracy.

FIG. 9 is a drawing for describing the abovementioned multiple conditions. It shows the positional relationship between the bottom surface (edge) 217*a* of each slot 217, and the detection surfaces 201*a* and 202*a* of the first and second sensors 201 and 202, respectively. The conditions (1)-(5) presented in FIGS. 8 and 9 are related to presence or absence of the slots 217, size (position of bottom surface in terms of vertical direction) of the slot 217, and presence or absence of the blocking portions 218. Referring to FIG. 9, z1 stands for the distance from the protective shutter 211 to the bottom surface (edge) 217*a* of the slot 217, and z2 stands for the distance from the protective shutter 211 to the detection surfaces 201*a* and 202*a*.

In this case, Condition (1) is "$z1 \leq 0$" (if z1 is negative, button surface (edge) 217*a* of slot 217 is positioned higher than bottom surface of protective shutter 211). That is, Condition (1) is that a sensor having no slot 217 was used. Condition (2) is "$0 < z1 \leq z2$". That is, it is such a condition that the sensor unit 200 which has the slots 217 was used, but, the bottom surface (edge) 217*a* of each slot 217 was positioned higher than the detection surfaces 201*a* and 202*a*. Condition (3) is "$z1 = z2$". That is, it is such a condition that in terms of the vertical direction, the bottom surface 217*a* of the slot 217 is the same in position as the detection surfaces 201*a* and 202*a*. Condition (4) is "$z1 > z2 > 0$". That is, it is such a condition that the bottom surface 217*a* of the slot 217 is positioned lower than the detection surfaces 201*a* and 202*a*. Condition (5) is a combination of Condition (4) and employment of a sensor unit, the protective shutter 211 of which is provided with the blocking portion 218.

In these experiments, images were formed, with the sensor units, which satisfy these conditions, being positioned as shown in FIG. 6, in order to obtain the relationship between the cumulative number of the sheets S of recording medium conveyed, and the amount by which the LED was supplied with electric power. The results of the experiments are shown in FIG. 8.

As will be evident from FIG. 8, in the case of Condition (1) in which the sensor unit 200 was provided with no slit 217, the detection surfaces 201*a* and 202*a* began to be soiled by foreign substances (contaminants) as the cumulative number of the conveyed sheets S of recording medium reached approximately 15,000, making it impossible for the sensors to detect the control toner images. In comparison, in the cases of Conditions (2)-(4), in which the sensors were provided with the slots 217, the lower was the bottom surface 217*a* of the slot 217 positioned, the smaller the amount by which the detection surfaces 201*a* and 202*a* were soiled by the foreign substances (contaminants). By the way, Conditions (3) and (4) were roughly the same in effectiveness, proving that all that is necessary is that the sensor unit 200 is structured so that the bottom surface 217*a* of the slot 217 is positioned no higher than the detection surfaces 201*a* and 202*a*, that is, "$z1 \geq z2$" is satisfied. To summarize, in this embodiment, it was preferred that "$z1 \geq z2$" is satisfied as in Conditions (3) and (4). However, as long as "$z1 < z2$" is satisfied as in Condition (2), it is possible to reduce the amount by which the detection surfaces 201*a* and 202*a* are soiled by foreign substances (contaminants).

In this embodiment, the size of each slot 217 was set so that "$z1 \approx z2$" is satisfied. Further, it became evident that providing the protective shutter 211 with the blocking portions 218 further reduces the amount by which the detection surfaces 201*a* and 202*a* are soiled. In this embodiment, the protective shutter 211 is provided with the blocking portions 218 as in the case of Condition (5). Therefore, even if an image forming operation is continued for a substantial length of time, the image forming apparatus 100 in this embodiment is substantially smaller in the amount by which the detection surfaces 201*a* and 202*a* are soiled by the foreign substances (contaminants). By the way, in this embodiment, the image forming apparatus 100 is structured so that the portion of the frame 209 which is not provided with the slot 217 is positioned higher than the bottom surface of the protective shutter 211. However, the portion of the frame 209, which is not provided with the slot 217, may be positioned lower than the bottom surface of the protective shutter 211. It is preferred that, in terms of the vertical direction, the portion of the frame 209, which is not provided with the slot 217, is positioned at roughly the same level as, or higher than, the protective shutter 211.

As is evident from the detailed description of the structure of the image forming apparatus 100 and its sensor unit 200, this embodiment can make it unlikely for foreign substances (contaminants) to adhere to the detection surfaces 201*a* and 202*a*, and therefore, can keep the first and second sensors 201 and 202 accurate for a long time. Thus, it can prevent, for a long time, an image forming apparatus from forming such unsatisfactory images that suffer from color deviation and density deviation. That is, the present invention makes it possible to provide an image forming apparatus which can output high quality images for a long period time.

[Miscellanies]

The intermediary transferring member does not need to be an endless belt. For example, it may be a drum. The sensor for detecting the toner images on the intermediary transferring member does not need to be an optical sensor like those described above. For example, it may be a means for detecting the toner images with the use of an image sensor. That is, this embodiment is not intended to limit the sensor unit in structure. All that is necessary is that the sensors are structured so that they detect toner images through the detection surface.

In the embodiment described above, the secondary transfer front roller 123 was positioned on the upstream side of the secondary transfer inside roller 122. However, the secondary transfer front roller 123 may be eliminated. In a case where the secondary transfer front roller 123 is not provided, the sensor unit 200 is to be positioned as close as possible to the secondary transfer inside roller 122.

Further, the openings with which the side walls of the sensor unit are provided do not need to be slots. For example, they may be ordinary holes. For example, in a case where the focal distance of the sensors is large, and therefore, the distance between the protective shutter 211 and detection surfaces 201*a* and 202*a* has to be large, the side walls may be provided with ordinary hole instead of the slots. In such a case, it is desired that the position of the bottom portion, or the bottom portion of the hole, that is, the opposite portion of the hole from the protective shutter 211, satisfies the same conditions as the bottom surface 217*a* of the slot 217. That is, the image forming apparatus 100 is to be structured so that in terms of the moving direction of the protective shutter 211, the openings align with the detection holes 216*a* and 216*b* when the protective shutter 211 is in its second position, and also, that in terms of the vertical direction, the openings are at least between the protective shutter 211, and the detection surfaces 201*a* and 202*a* of the first and second sensors 201 and 202. In a case where the openings are ordinary holes, the image forming apparatus 100 is to be structured so that the highest point of the holes is higher than the detection surfaces 201*a* and 202*a*.

Further, in the embodiment described above, the image forming apparatus 100 was structured so that the positional relationship between the bottom surface 217*a* of the slot 217 and the detection surfaces 201*a* and 202*a* satisfies "$z1 \geq z2$." However, the image forming apparatus 100 may be structured so that "$z1 < z2$" is satisfied. Even Condition (2), in which "$z1 < z2$", is effective compared to Condition (1) in which the side wall 209*a* is not provided with slots. Thus, the image forming apparatus 100 may be structured so that the slots 217 satisfy Condition (2).

By the way, in this embodiment, the detection surfaces 201*a* and 202*a* of the sensors 201 and 202 were parts of a transparent member (which in this embodiment was acrylic plate). However, the transparent member may be replaced with a piece of nontransparent plate provided with openings as light passages. In this embodiment, the openings through which light is allowed to reach the sensors 201 and 202 are also considered as detection windows.

The present invention makes it possible to provide an image forming apparatus structured so that foreign substances (contaminants) are unlikely to adhere to the detection surfaces of the sensors of the sensor unit of the apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-245735 filed on Dec. 19, 2016, which is hereby incorporated by reference herein in its entirety.

What is claimed is:

1. An image forming apparatus, comprising:

an image bearing member;

a rotatable intermediary transfer belt configured to receive a toner image from said image bearing member at a primary transfer portion opposing said image bearing member;

a secondary transfer roller configured to contact said intermediary transfer belt to transfer the toner image from said intermediary transfer belt onto the recording material at a secondary transfer portion;

a feeding path configured to feed the recording material to said secondary transfer portion;

a sensor unit provided below said intermediary transfer belt and opposed to said intermediary transfer belt and said feeding path at a position downstream of said primary transfer portion and upstream of said secondary transfer portion and including a sensor configured to detect the toner image on said intermediary transfer belt and a shutter configured to open and close the sensor;

wherein said shutter includes an exposing portion configured to expose a window of said sensor to permit detection of the toner image on said intermediary transfer belt and a cover portion configured to cover said window of said sensor, wherein said sensor unit is provided with a side wall disposed at a position upstream of said sensor with respect to a rotating direction of said intermediary transfer belt and crossing with a plane of said shutter, wherein said side wall is provided with a cut-away portion at a top end thereof, wherein as viewed in a direction facing said side wall, said cut-away portion overlaps an imaginary range provided by extending said exposing portion in a direction perpendicular to a surface of said shutter when said shutter is in a closing position, and wherein a lower end of said cut-away portion is below a lower surface of said shutter, and is opposed to said exposing portion when said shutter is in the closing position.

2. An apparatus according to claim 1, wherein the lower end of said cut-away portion is even with or lower than a top of said window.

3. An apparatus according to claim 1, wherein a level of the top end of said side wall in a range of said window, with respect to the moving direction of said shutter, is higher than the lower surface of said shutter.

4. An apparatus according to claim 1, wherein a width of said cut-away portion is longer than said exposing portion in a moving direction of said shutter.

5. An apparatus according to claim 1, wherein opposite end portions of the cut-away portion are outside of opposite end portions of said exposing portion, respectively, when said shutter is in the closing position with respect to a moving direction of said shutter.

6. An apparatus according to claim 1, wherein said sensor is disposed at such a position that a distance measured along a surface of said intermediary transfer belt to said secondary transfer roller is not more than a length, measured in a recording material feeding direction, of the recording material having a maximum size usable with said apparatus.

7. An apparatus according to claim 1, wherein said sensor is disposed at such a position that a distance measured along a surface of said intermediary transfer belt to said secondary transfer portion is not more than a length, measured in a recording material feeding direction, of the recording material having a minimum size usable with said apparatus.

8. An apparatus according to claim 1, further comprising a projected portion, provided on said shutter, projecting downwardly from a lower surface of said shutter at a position between said exposing portion and said window when said shutter is in the closing position with respected to a moving direction of said shutter.

9. An apparatus according to claim 1, further comprising a sensor holder supporting said sensor, wherein said side wall supports said sensor holder, and the lower end of said cut-away portion is above a fixing portion of said side wall which fixes said sensor holder.

10. An image forming apparatus, comprising:

an image bearing member;

a rotatable intermediary transfer belt configured to receive a toner image from said image bearing member at a primary transfer portion opposing said image bearing member;

a secondary transfer roller configured to contact said intermediary transfer belt to transfer the toner image from said intermediary transfer belt onto a recording material at a secondary transfer portion;

a feeding path configured to feed the recording material to said secondary transfer portion; and a sensor unit provided below said intermediary transfer belt and opposed to said intermediary transfer belt and the feeding path at a position downstream of said primary transfer portion and upstream of said secondary transfer portion and including a sensor configured to detect the toner image on said intermediary transfer belt and a shutter configured to open and close the sensor, wherein said shutter includes an exposing portion configured to expose a window of said sensor to permit detection of the toner image on said intermediary transfer belt and a cover portion configured to cover said window of said sensor, wherein said sensor unit is provided with a side wall disposed at the position upstream of said sensor with respect to a rotating direction of said intermediary transfer belt and crossing with a plane of said shutter, wherein said side wall is provided with an opening, wherein as viewed in a direction facing said side wall, said opening overlaps an imaginary range provided by extending said exposing portion in a direction perpendicular to a surface of said shutter when said shutter is in the closing position, and wherein a lower end of said opening is below a bottom surface of said shutter, and is opposed to said exposing portion when said shutter is in the closing position.

11. An apparatus according to claim 10, wherein the lower end of said opening is even with or lower than a top of said window.

12. An apparatus according to claim 10, wherein opposite end portions of said opening are outside of opposite end portions of said exposing portion, respectively, when said shutter is in the closing position with respect to a moving direction of said shutter.

13. An apparatus according to claim 10, further comprising a sensor holder supporting said sensor, wherein said side wall supports said sensor holder, and the lower end of said opening is above a fixing portion of said side wall which fixes said sensor holder.

14. An image forming apparatus, comprising:

an image bearing member;

a rotatable intermediary transfer belt configured to receive a toner image from said image bearing member at a primary transfer portion opposing said image bearing member;

a secondary transfer roller configured to contact said intermediary transfer belt to transfer the toner image from said intermediary transfer belt onto a recording material at a secondary transfer portion;

a feeding path configured to feed the recording material to said secondary transfer portion; and a sensor unit provided below said intermediary transfer belt and opposed to said intermediary transfer belt and said feeding path at a position downstream of said primary transfer portion and upstream of said secondary transfer portion and including a sensor configured to detect the toner image on said intermediary transfer belt and a shutter configured to open and close the sensor, wherein said shutter includes an exposing portion configured to expose a window of said sensor to permit detection of the toner image on said intermediary transfer belt and a cover portion configured to cover said window of said sensor, wherein said sensor unit is provided with a side wall disposed at a position upstream of said sensor with respect to a rotating direction of said intermediary transfer belt and crossing with a plane of said shutter, wherein an upper end of said side wall includes a first upper end and a second upper end at positions different from each other with respect to a moving direction of said shutter, wherein as viewed in a direction facing said side wall, said first upper end overlaps an imaginary range provided by extending said exposing portion in a direction perpendicular to a surface of said shutter when said shutter is in the closing position, wherein as viewed in the direction facing said side wall, said second upper end overlaps an imaginary range provided by extending said window portion in a direction perpendicular to a surface of said shutter, and wherein a top end of said first upper end portion is at a level lower than that of said second upper end, and when said shutter is at the closing position, a gap formed between said first upper end portion and said shutter is opposed to said window.

15. An apparatus according to claim 14, further comprising a sensor holder supporting said sensor, wherein said side wall supports said sensor holder, and a lower end of said top end of said first upper end portion is above a fixing portion of said side wall which fixes said sensor holder.

* * * * *